US008813719B2

(12) United States Patent
Sailer et al.

(10) Patent No.: US 8,813,719 B2
(45) Date of Patent: Aug. 26, 2014

(54) INTERNAL COMBUSTION PISTON ENGINE WITH A COMPRESSION RELIEF ENGINE BRAKE

(75) Inventors: Peter Sailer, Erlangen (DE); Oliver Schnell, Veitsbronn (DE); Oliver Witter, Westhausen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 724 days.

(21) Appl. No.: 13/048,231

(22) Filed: Mar. 15, 2011

(65) Prior Publication Data

US 2011/0220062 A1 Sep. 15, 2011

(30) Foreign Application Priority Data

Mar. 15, 2010 (DE) ..... 10 2010 011 454

(51) Int. Cl.
*F02D 13/04* (2006.01)

(52) U.S. Cl.
USPC ..... 123/321; 123/90.23

(58) Field of Classification Search
USPC ..... 123/90.12, 90.16, 90.22, 90.23, 320, 123/321
See application file for complete search history.

(56) References Cited

U.S. PATENT DOCUMENTS

| | | | | |
|---|---|---|---|---|
| 3,809,033 | A | 5/1974 | Cartledge | |
| 7,909,015 | B2 * | 3/2011 | Yang | 123/321 |
| 8,065,987 | B2 * | 11/2011 | Yang | 123/321 |
| 2007/0144472 | A1 * | 6/2007 | Yang | 123/90.16 |
| 2010/0006062 | A1 * | 1/2010 | Yang | 123/321 |
| 2010/0319657 | A1 * | 12/2010 | Dodi et al. | 123/321 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

An internal combustion piston engine based on a four-stroke process, including a crankcase in which at least one cylinder/piston assembly is arranged, the piston being guided by a connecting rod connected to a crankshaft. At least one cylinder head closes the cylinder, each of whose intake and exhaust channels are controlled by at least one intake valve and one exhaust valve (13, 13*a*). The intake and exhaust valves (13, 13*a*) are actuable by a rocker arm (5) or a finger lever driven by a camshaft (1) through intake and exhaust cams (2). The rocker arms or finger levers are guided on at least one axle (6). A brake control device is provided which includes, in the region of the base circle of the exhaust cam (2), at least one additional cam (1) for an additional opening of at least one of the exhaust valves (13, 13*a*). A control element (12, 12*a*) is installed between the rocker arm (5) or finger lever and the exhaust valve or valves (13, 13*a*), which control element (12, 12*a*) can be connected to the pressurized oil circulation system of the internal combustion piston engine and whose length can be varied, so that the additional cam (3) is active during a braking operation and inactive during a pure engine operation. The control element (12) is arranged in a bridge (11) that is associated with a plurality of exhaust valves (13, 13*a*).

6 Claims, 5 Drawing Sheets

INTERNAL COMBUSTION PISTON ENGINE WITH A COMPRESSION RELIEF ENGINE BRAKE

CROSS-REFERENCE TO RELATED APPLICATIONS

This application claims the benefit of German Patent Application No. 102010011454.5, filed Mar. 15, 2010, which is incorporated herein by reference as if fully set forth.

FIELD OF THE INVENTION

An internal combustion piston engine based on a four-stroke process, comprising a crankcase in which at least one cylinder/piston assembly is arranged, the piston being guided by a connecting rod connected to a crankshaft, at least one cylinder head for closing the cylinder, each of whose intake and exhaust channels are controlled by at least one intake valve and one exhaust valve, said intake and exhaust valves being actuable by a rocker arm or a finger lever driven by a camshaft through inlet and exhaust cams, the rocker arms or finger levers being guided on at least one axle, and further comprising a brake control device which comprises, in the region of the base circle of the exhaust cam at least one additional cam for an additional opening of the at least one exhaust valve, and in which a control element is installed between the rocker arm or finger lever and the exhaust valve or valves, which control element can be connected to the pressure oil circulation of the internal combustion piston engine and whose length can be varied, so that the additional cam is active during a braking operation and inactive during a pure engine operation.

BACKGROUND OF THE INVENTION

A generic internal combustion piston engine of the precited type is known from U.S. Pat. No. 3,809,033. An actuating piston installed in the rocker arm of this engine is operatively connected to a bridge associated to two exhaust valves. The pressure chamber of the actuating piston is controlled by a control valve, so that oil pressure can be increased and decreased and the actuating piston can be retracted for the performance operation of the internal combustion engine or extended for the braking operation. The additional cam is active in the one case and inactive in the other.

A drawback of this configuration is particularly that, due to the spatial arrangement in the rocker arm, it is only possible to open all the exhaust valves intermediately at the same time, and this is only restrictedly desired. Furthermore, this also makes the installation of a hydraulic lash adjusting element for simplifying maintenance of the internal combustion engine more difficult.

Further, an internal combustion piston engine comprising a compression relief brake device is also known (DE-30 03 566 A1). In this internal combustion engine, the additional cam is configured as a movable component that can be pushed into the base circle contour or pushed outwards out of the base circle contour. For this purpose, the camshaft has a hollow configuration and comprises an actuating device which displaces the additional cam. The actuating device must further also comprise actuating elements outside of the camshaft, through which actuating elements the inner actuating device is controlled.

The required structural complexity for extending and retracting the additional cams is considerably high and cost-intensive and therefore considered as a drawback.

SUMMARY OF THE INVENTION

It is therefore the object of the invention to improve an internal combustion piston engine with the initially described features, so as to provide an effective engine brake through intermittent opening of even one out of a plurality of exhaust valves in the region of the upper dead center of the internal combustion piston engine, which brake must be realizable through simple measures and low costs. In addition, this should be accomplished in connection with components of a hydraulic lash adjusting element.

The invention achieves the above object by the fact that control element is arranged in a bridge that is associated to a plurality of exhaust valves.

If the control element is arranged at a central position in the bridge and is operatively connected to the free end of the rocker arm or finger lever, the control element is active for both exhaust valves.

If, in contrast, the control element is arranged on one end of the bridge and is operatively connected only to a stem of one exhaust valve, the control element is associated only to one exhaust valve.

In an advantageous development of the invention, the control element comprises components, known per se, of a of a hydraulic lash adjusting element. A control piston is associated to the components of the hydraulic valve lash adjusting element, which control piston is loaded on one side by a spring and can be loaded on another side by pressure oil and can therefore be brought into operative connection to the valve body of a non-return valve of the valve lash adjusting element in opening direction.

When the control piston is loaded with reduced oil pressure, the spring presses the control piston against the valve body of the non-return valve, which is preferably configured as a ball, and opens this. As a result, the control element can get shortened, so that the additional cam is inactive and no compression relief opening of the exhaust valve or valves takes place. The rocker arm or finger lever, if necessary also an installed tappet, is in constant contact with the additional cam. The additional lift, however, is suppressed in this case by the control element.

When the control piston is loaded through oil pressure, the non-return valve can close and a pressure is built up in the hydraulic valve lash adjusting element. As a result, the high pressure chamber is formed, the working piston being situated in the extended position, also through the force of the compression spring. The thus formed high pressure chamber causes the activation of the additional cam which leads to a switching-on of the engine brake.

During the performance operation of the engine, it is also possible to displace the transmitting elements situated between the exhaust cam and the exhaust valves so far in a direction towards the exhaust valves, preferably by spring-loading, that the respective component connected to the exhaust cam does not come into contact with the base circle and the additional cam.

BRIEF DESCRIPTION OF THE DRAWINGS

For a further elucidation of the invention reference will be made to the appended drawings in which examples of embodiment of the invention are shown in simplified illustrations. The figures show.

DETAILED DESCRIPTION OF THE PREFERRED EMBODIMENTS

Figure 1:
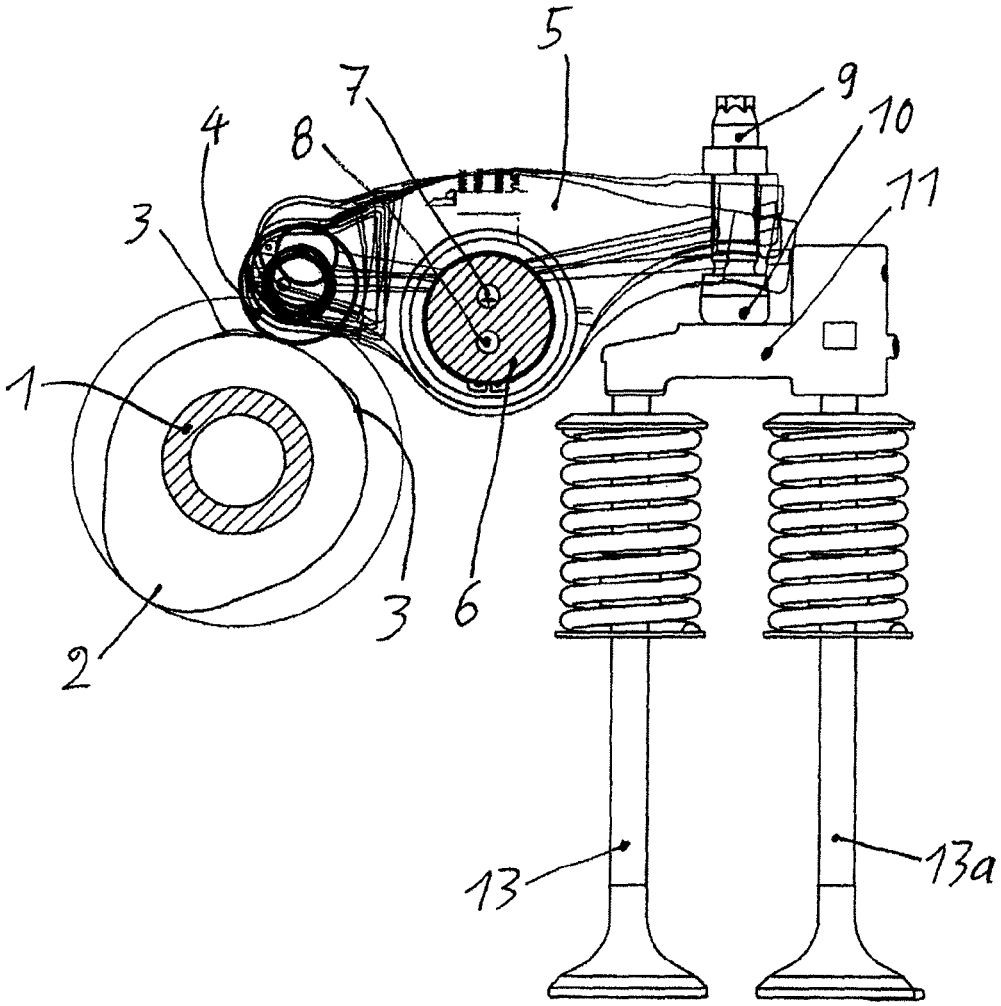
FIG. 1: a side view of a valve train including a sectional view through a camshaft and an axle for rocker arms, as also a view of exhaust valves, a bridge and a rocker arm.
Figure 2:
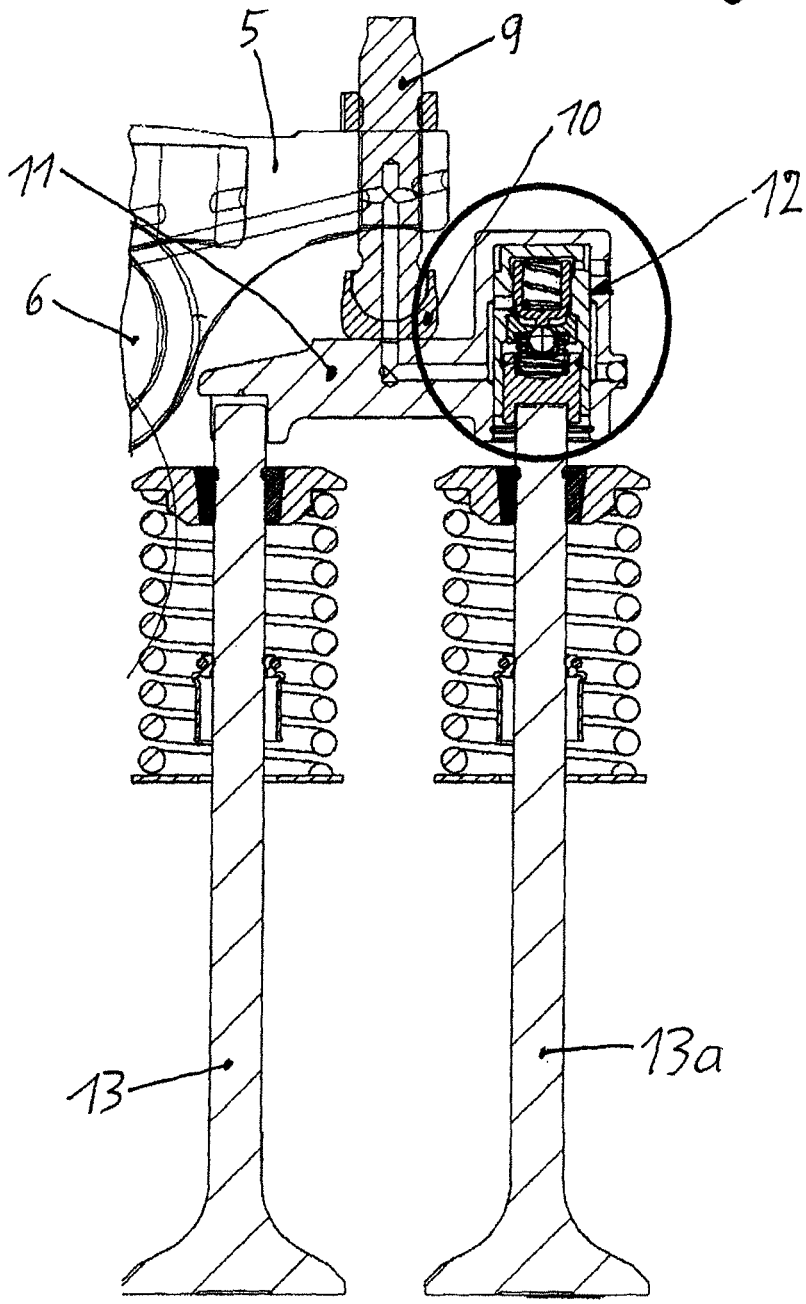
FIG. 2: a sectional view through the exhaust valves, the rocker arm and the bridge of FIG. 1, FIG. 3: a sectional view through a control element corresponding to FIGS. 1 and 2, FIG. 4: a side view of a valve train similar to FIG. 1, with a modified bridge.
Figure 6:
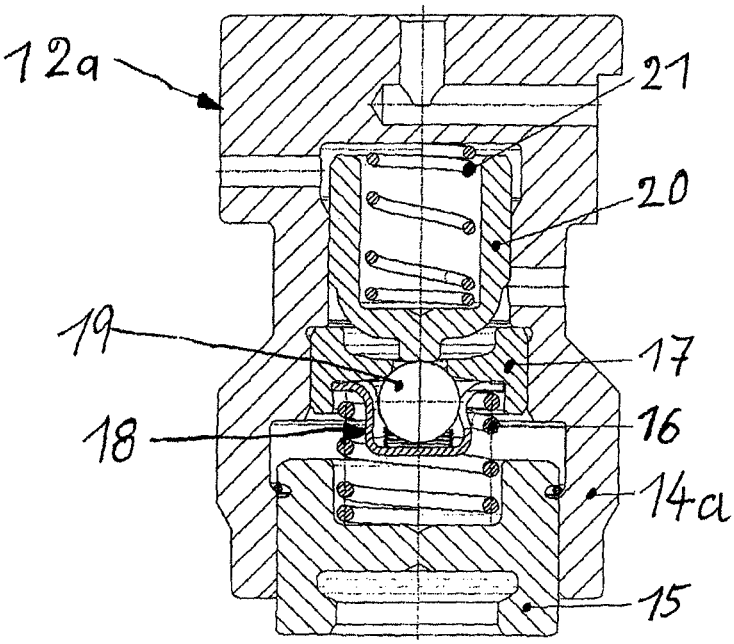
FIG. 6: a sectional view through a control element of FIG. 4.
Figure 4:
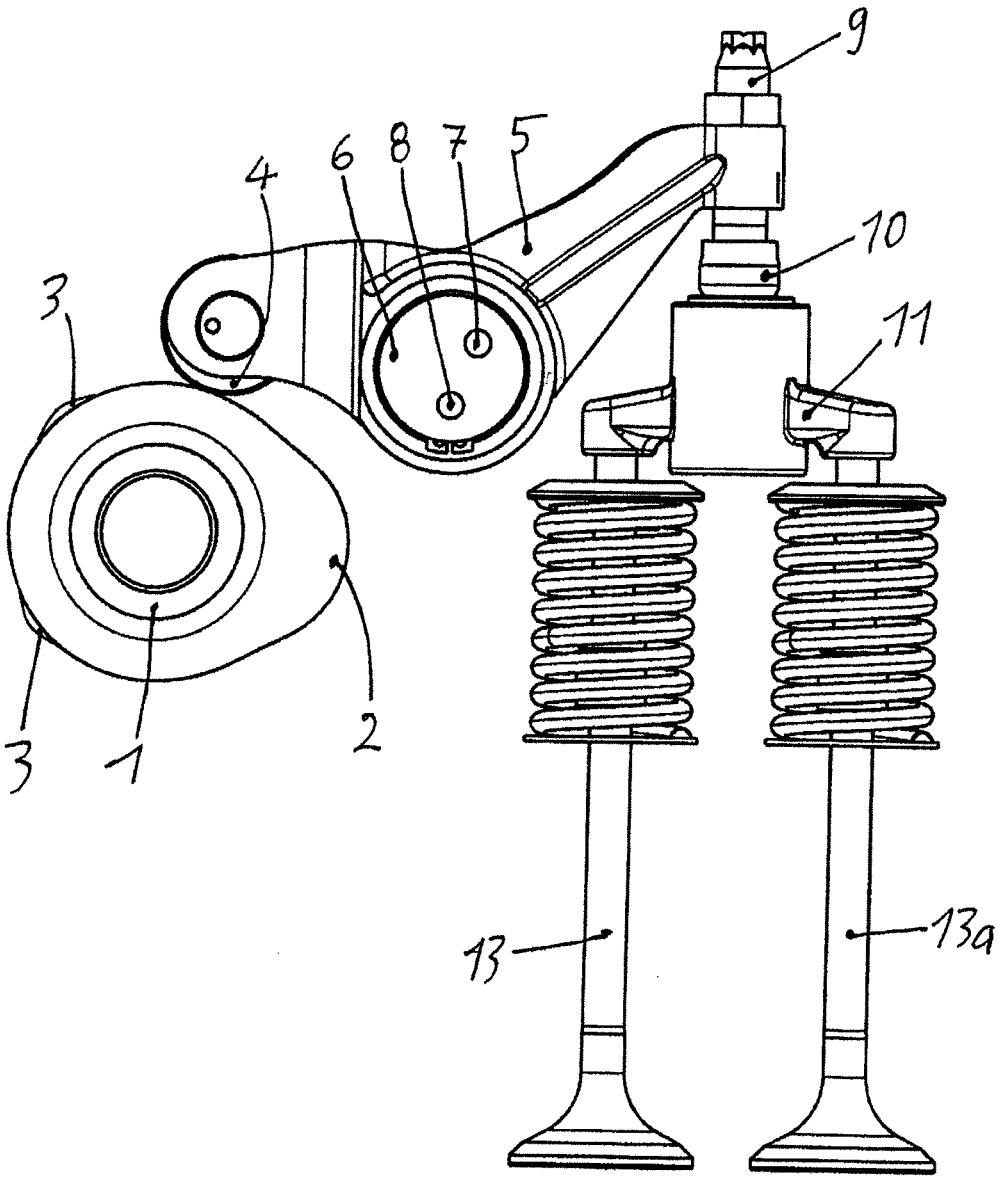
Figure 5:
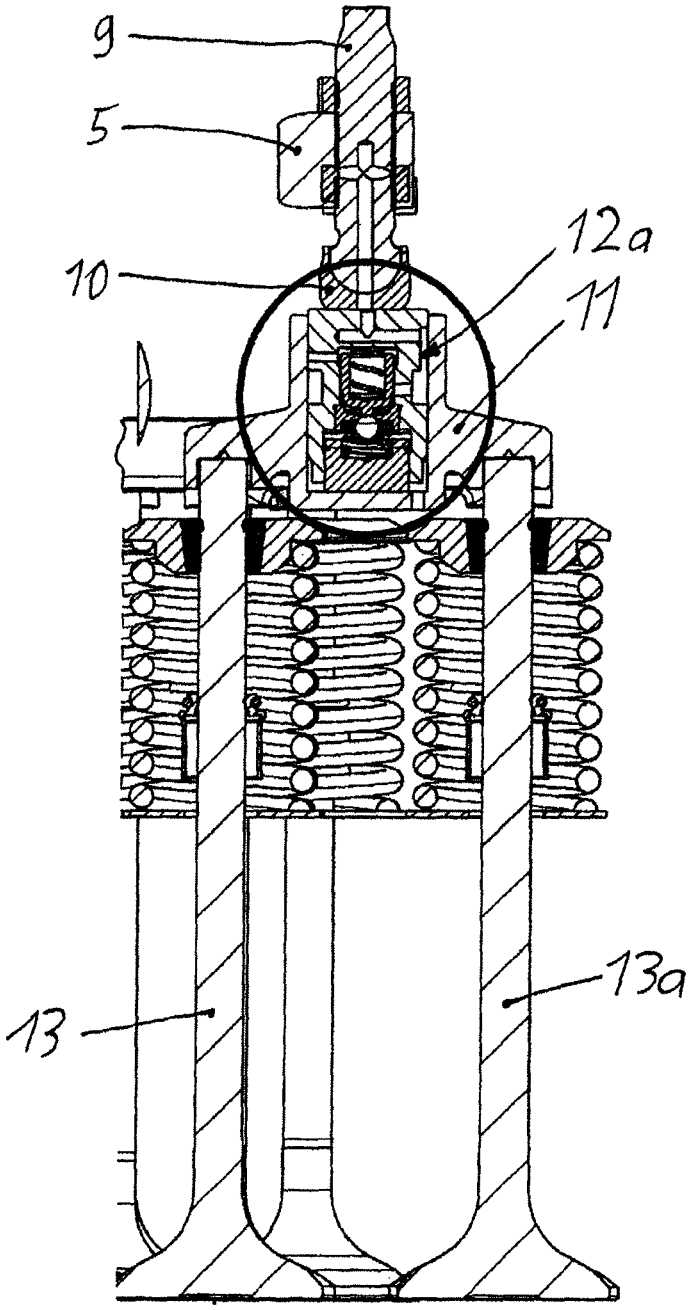
FIG. 5: a sectional view through exhaust valves, a bridge according to FIG. 4 and a part of the rocker arm.

In FIGS. 1 and 6 a camshaft, as far as specifically shown, is identified at 1, on which camshaft are arranged, among other things, exhaust cams 2. Additional cams 3 are arranged in the region of the base circle of the exhaust cams 2 according to FIGS. 1 and 4 and serve for producing compression relief strokes of one or two exhaust valves. A rocker arm 5, mounted on an axle 6, is connected through a roller 4 to the exhaust cams 2. The axle 6 comprises bores 7 and 8 serving for a pressurized oil supply and a pressure oil discharge. An adjusting screw 9 is screwed onto the further end of the rocker arm 5 and is connected, in FIG. 2, through a ball socket 10 to a bridge 11 and to a control element 12*a* in FIG. 4. Bores in the rocker arm 5, in the adjusting screw 9 and in the ball socket 10 are connected to one of the bores 7 or 8 in the axle 6 and lead, according to FIG. 2, into bores in the bridge 11 which lead to the control element 12 on one end of the bridge 11. In FIG. 4, the bore in the ball socket 10 is connected to an oil channel that leads directly into control element 12*a*. In FIG. 2, the exhaust valve identified at 13 is supported on the bridge 11, while the exhaust valve identified at 13*a* is connected to the control element 12. In FIG. 4 both exhaust valves 13, 13*a* are supported on the bridge because the control element 12*a* is arranged at a central position in the bridge 11.

Figure 3:
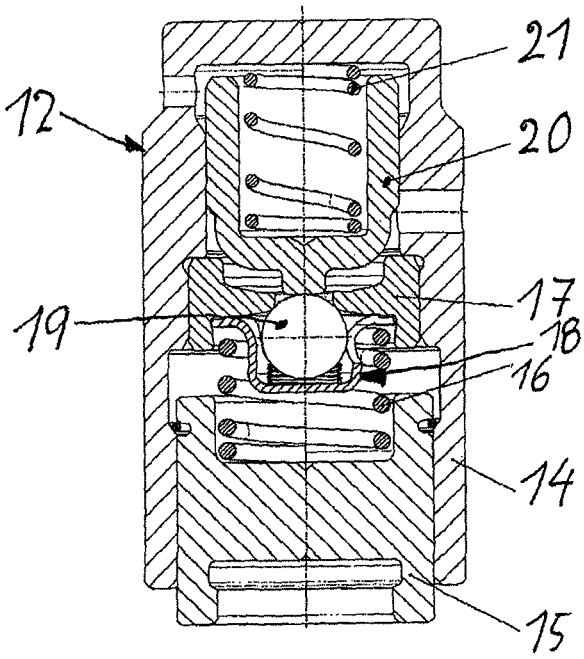

The control elements according to FIGS. 3 and 6 have a basically similar structure. They differ from each other in size and by a modification of the outer housing. The control element 12 according to FIG. 3 comprises an outer housing 14 in which a working piston 15 is inserted. The working piston 15 is supported through a compression spring 16 on a piston 17 of the hydraulic lash adjusting element in which a non-return valve 18 comprising a ball 19 as a valve body is arranged. Adjoining the piston 17, which is pressed into the housing 14, 14*a*, is arranged a control piston 20 which is loaded by a spring 2 in a direction towards the non-return valve 18 and can be loaded on the opposite side through pressure oil which can be fed in a controlled manner from the axle 6 through different bores. Control valves, not illustrated, are installed in the pressure oil supply to the control piston 20 and control the supply flow of the pressure oil and its return flow. Moreover, a leak oil duct is arranged on the installation space of the spring 21 to prevent an undesired pressure build-up in this space. The control element 12 differs from the control element 12*a* in that the outer housing identified at 14*a* comprises recesses and turned grooves to assure a reliable supply flow of pressure oil from the ball socket 10 to the control piston 20.

As already mentioned in the general description, when the control piston 20 is supplied with a reduced oil pressure, the control piston opens the ball 19 due to the force of the spring 21, and the working piston 15 gets pushed into the respective outer housing 14 or 14*a*, so that the additional cam 3 is inactive. When the control piston is loaded with a higher oil pressure, the spring 21 is compressed and the non-return valve can close after a pressure build-up in the high pressure chamber and a force application to the working piston, so that the working piston is extended and the additional cam 3 is activated by the roller 4 and effects an additional brake opening of the exhaust valve or valves 13 and 13*a*.

LIST OF REFERENCE NUMERALS

1 Camshaft
2 Exhaust cam
3 Additional cam
4 Rollers
5 Rocker arm
6 Axle
7, 8 Bores
9 Adjusting screw
10 Ball socket
11 Bridge
12, 12*a* Control elements
13, 13*a* Exhaust valves
14, 14*a* Outer housing
15 Working piston
16 Compression spring
17 Piston
18 Non-return valve
19 Ball
20 Control piston
21 Spring

The invention claimed is:

1. An internal combustion piston engine based on a four-stroke process, comprising a crankcase in which at least one cylinder/piston assembly is arranged, the piston being guided by a connecting rod connected to a crankshaft, at least one cylinder head for closing the cylinder, the intake and exhaust channels of the at least one cylinder are controlled by at least one intake valve and one exhaust valve, said intake and exhaust valves being actuable by a rocker arm or a finger lever driven by a camshaft through intake and exhaust cams, the rocker arms or finger levers are guided on at least one axle, and a brake control device which comprises, in a region of a base circle of the exhaust cam, at least one additional cam for an additional opening of at least one of the exhaust valves, and in which a control element is installed between the rocker arm or finger lever and the at least one exhaust valve, the control element comprising a separate outer housing and a working piston and a control piston assembled within the separate housing, the control element is connected to a pressurized oil circulation system of the internal combustion piston engine and has a length that can be varied, so that the additional cam is active during a braking operation and inactive during a pure engine operation, the control element is arranged in a bridge that is associated with a plurality of the exhaust valves.

2. The internal combustion piston engine according to claim 1, wherein the control element is arranged on one end of the bridge which is associated with a plurality of the exhaust valves, said control element being operatively connected to a stem of one of the exhaust valves.

3. The internal combustion piston engine according to claim 1, wherein the control element is arranged approximately at a central position in the bridge which is associated with a plurality of the exhaust valves, said control element being operatively connected to a free end of the rocker arm or finger lever.

4. The internal combustion piston engine according to claim 1, wherein a control piston is associated with elements of a hydraulic valve lash adjusting element, the control piston is loaded on one side by a spring and can be loaded on another side by pressurized oil and to be brought into operative connection to a valve body of a non-return valve in an opening direction.

5. The internal combustion piston engine according claim 1, wherein transmitting elements between the exhaust cam and the exhaust valves are loaded by spring force so far in direction towards the exhaust valves that, during a performance operation of the internal combustion engine, no contact takes place with the base circle and the additional cam.

6. The internal combustion piston engine according to claim 5, wherein the transmitting elements comprise the rocker arms or finger levers.

* * * * *